US005247754A

United States Patent [19]

Belokin, Jr.

[11] Patent Number: 5,247,754

[45] Date of Patent: Sep. 28, 1993

[54] BEVERAGE ADVERTISING DISPLAY

[75] Inventor: Paul Belokin, Jr., Denton, Tex.

[73] Assignee: Martin Paul, Inc., Denton, Tex.

[21] Appl. No.: 811,741

[22] Filed: Dec. 23, 1991

[51] Int. Cl.[5] ..... G09F 19/10

[52] U.S. Cl. ..... 40/414; 40/430; 40/617; 429/97; 446/236

[58] Field of Search ..... 40/414, 411, 427; 446/236; 429/96, 97, 99, 123; 220/906, 269; D9/367, 368, 373, 374; D20/37; 267/180, 272, 108, 160, 164

[56] References Cited

U.S. PATENT DOCUMENTS

| | | | |
|---|---|---|---|
| 2,058,755 | 10/1936 | Arnesen | 429/97 |
| 2,971,671 | 2/1961 | Shakman | 226/906 |
| 3,964,189 | 6/1976 | Belokin, Jr. . | |
| 4,568,287 | 2/1986 | Wedeski | 40/430 |
| 4,901,458 | 2/1990 | Belokin et al. . | |
| 4,904,220 | 2/1990 | Williams et al. | 446/236 |
| 5,146,702 | 9/1992 | Belokin, Jr. | 446/236 |

FOREIGN PATENT DOCUMENTS

| | | | |
|---|---|---|---|
| 534177 | 2/1941 | United Kingdom | 429/97 |
| 768467 | 2/1957 | United Kingdom | 40/429 |

*Primary Examiner*—Kenneth J. Dorner
*Assistant Examiner*—C. Hope Davis
*Attorney, Agent, or Firm*—Nilles & Nilles

[57] ABSTRACT

A beverage advertising display is provided with a motorized simulation of a liquid pouring out of an aluminum beverage can and provided with a battery compartment for easy access and replacement of batteries. The liquid pouring simulation is achieved by rotating a tapered ribbon affixed by a disc to a rotatable shaft on a motor. The disc is concentrically affixed to a circular surface area at the top end of the ribbon. The battery compartment holds a pair of batteries inside a pair of cavities in the bottom section of the beverage container. A double-ended spring clip rotatably mounted between the cavities holds the batteries therein, provides electrical contact between the batteries to power the motor, and provides easy access to replace the batteries.

23 Claims, 3 Drawing Sheets

BEVERAGE ADVERTISING DISPLAY

BACKGROUND OF THE INVENTION

1. Field of the Invention

This invention relates to an advertising display for beverage products, and more particularly to a beverage advertising display which includes a motorized rotating ribbon for simulating a liquid being poured from a beverage container and includes a battery compartment for holding batteries to power the motor.

2. BACKGROUND OF THE RELATED ART

U.S. Pat. No. 3,964,189, issued Jun. 22, 1976, entitled "Advertising Display", shows an animated advertising display which simulates a liquid beverage pouring out of a bottle. The display, suspended for rotation about a vertical axis, carries a motor and power source that rotate a depending ribbon about an inclined axis to create the illusion of a natural pouring stream of liquid. The ribbon is attached to a rotating shaft on the motor by means of an S-shaped hook. One end of the hook is attached to the rotating shaft and the other end is attached to the ribbon through a hole eccentrically disposed from the center of the top end of the ribbon. The ribbon is also curved in a plane to a radial depth intermediate its ends. This arrangement, however, has several drawbacks. It does not provide for as lifelike a looking simulation of pouring liquid as desired. The ribbon may be rotated in only one direction. Furthermore, the battery compartment on this known device is difficult to access for changing the batteries.

U.S. Pat. No. 4,901,458, issued Feb. 20, 1990, entitled "Simulated Winged Insect or the Like for Advertising Display," shows a simulated winged insect mounted on a thin wire and rotatably driven by a battery operated motor to simulate flight. A disc member having a central hole is pressed over the drive shaft of the motor. The disc member has a hole adjacent the periphery of the member for inserting one end of the thin wire and mounting the simulated insect at the other end of the wire. When the disc member is driven by the motor, the simulated insect on the peripherally mounted wire gives the appearance of a fluttering butterfly above the display.

SUMMARY OF THE INVENTION

The present invention provides for a beverage advertising display having an improved simulation of a beverage pouring out of a container and an improved battery holding compartment.

An object depicting a beverage container is suspended from a ceiling or other high place with a rotatable support means for rotating the object about a vertical axis. The object is mounted in a manner which inclines the beverage container at a pouring position. A motor on the lower end of the object provides a driven rotatable shaft. An elongated flexible ribbon, tapered from a broad top end to a narrow bottom end, is adhesively affixed to a disc mounted on the rotatable shaft. The top end of the ribbon has a substantially circular surface with a diameter in excess of the tapered width of the ribbon adjacent thereto, and the circular surface of the top end is concentrically affixed to disc. When the shaft is rotated, the disc mounted ribbon provides a more efficient interaction with the ambient air over the known prior art advertising display, thereby creating an improved, more lifelike simulation of a liquid pouring out of its container. In addition to the disc mounted arrangement of the ribbon, the tapered edges of the ribbon are straight, which allows the ribbon to rotate in either a clockwise or counterclockwise direction, so the user no longer must concern himself with the polarity of the batteries which power the motor. Further, small weights are provided on both sides of the bottom end of the ribbon which causes the container to rotate about the vertical axis in a more reliable manner than the prior known display.

The beverage advertising display of the invention is further provided with an improved battery compartment comprising a pair of spaced apart cylindrical cavities, with the width and depth of each cavity corresponding to the respective width and length of an ordinary flashlight battery. A double-ended spring means for securing a pair of batteries in the battery compartment is swivel mounted between the cavities. The double-ended spring means further acts as a switch to provide electrical contact between the batteries to power the motor. This improved arrangement of the battery compartment provides for easier access to the battery compartment over the prior known devices.

The principal objects of the invention are therefore to provide an animated advertising beverage display having a ribbon adhesively affixed to a disc mounted on a rotating shaft for creating an improved illusion of liquid pouring from a beverage container; to provide a liquid simulating ribbon that is rotatable without regard to the polarity of the power source; and to provide a swivel mounted battery holding clip for electrical switching and for easy access to the battery compartment.

Other objects and advantages of this invention will become apparent from the following description taken in connection with the accompanying drawings which set forth, by way of illustration and example, certain embodiments of this invention.

BRIEF DESCRIPTION OF THE DRAWINGS

The drawings, which constitute part of the specification and include exemplary embodiments of the present invention, include the following.

DETAILED DESCRIPTION

Figure 6:
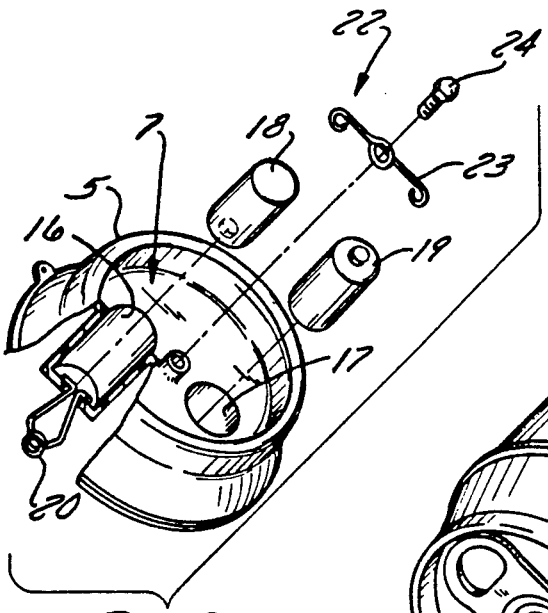
FIG. 6 is an exploded perspective view of the battery compartment with parts broken away and in section.
Figure 1:
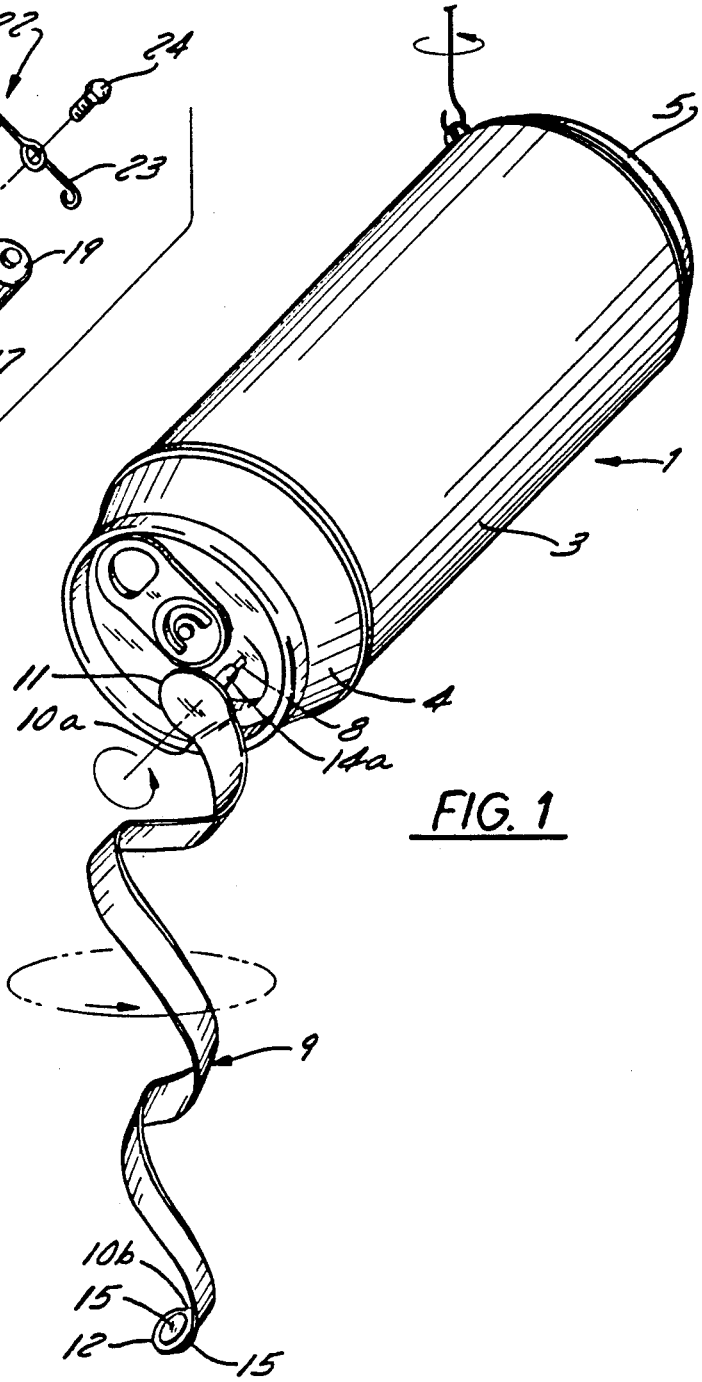
FIG. 1 is a perspective view of the beverage advertising display according to the invention.

Referring to FIG. 1, an object depicting a beverage container 1 is mounted at an inclined position representing a pouring position of the beverage container. The container 1 is mounted from a ceiling or other high stationary structure with a swivel mount 2, which permits the container 1 to rotate about a vertical axis. The container 1 may be a can, bottle or any other beverage holding container. In the case of a can, the object may be formed by a rectangular piece of cardboard stock, plastic or other flexible material rolled and joined end-to-end to form a cylinder 3 with two open ends. A circular top section 4 shaped like a can top of a typical aluminum beverage can is inserted into one open end of the cylinder 3, and a circular bottom section 5 shaped like a can bottom is inserted into the other open end of the cylinder.

The rectangular sheet prior to its formation into a cylinder 3 for a beverage container display can be easily printed with artwork to represent a particular advertiser's product, such as soda, beer, juice, mineral water, and the like.

In the embodiment shown in FIG. 1, the can top 4 (shown in the lower portion of FIG. 1 since the can 1 is tipped over in a pouring position) is provided with a small electric motor 6, and the can bottom 5 (shown in the upper portion of FIG. 1) is provided with a battery compartment 7 to power the motor 6. By locating the battery compartment 7 on the can bottom 5, the batteries act as a counterweight to properly balance the display. Further, the relatively heavy batteries are located near the vertical axis which enables the display to rotate about the vertical axis with a lower force than the prior known display device.

The motor is positioned near the edge of the can top at a point representing the opening of a typical flip-top aluminum beverage can. The motor has a rotatable shaft 8 protruding in a direction parallel to the axis of the cylindrically shaped beverage can, which is inclined from the vertical axis.

An elongated ribbon or streamer 9 is mounted on the end of the rotatable shaft 8 on the motor 6. The ribbon 9 has straight, tapered edges 10 which are progressively narrowed from a relatively broad top width 10*a* to a relatively narrow bottom width 10*b*. The top end of the ribbon has a circular surface area 11 with a diameter in excess of the tapered broad top width 10*a* of the ribbon 9, preferably about two inches to one inch. Similarly, the bottom end of the ribbon has a circular surface area 12 having a diameter in excess of the tapered narrow bottom width 10*b* of the ribbon 9, again preferably about a two to one ratio.

A thin, flexible pad, such as, for example, a circular foam rubber pad 13 having adhesive material on both of its sides, is adhesively affixed on the center of the top circular surface area 11. The pad 13 in turn is adhesively affixed to a circular plastic disc 14. This arrangement permits easy and quick assembly of the ribbon on the disc 14. The disc 14 has an elongated hub 14*a* having a central bore 14*b* therein. The plastic disc 14 is then mounted on the rotatable shaft 8 of the motor 6 by its bore 14*b* being snugly slipped over the shaft 8. The disc 14, pad 13 and top circular surface area 11 of the ribbon 9 are affixed concentrically with the axis of the shaft. This provides a tight, lightweight assembly. At the bottom end of the ribbon 9, a small disc-shaped weight 15 is adhesively affixed to the center of the bottom circular surface area 12. As the ribbon 9 is rotated by the motor, the rotating weight 15 on the end of the ribbon provides a force which causes the can 1 to rotate about the vertical axis. A disc weight 15 may be applied to both sides of the ribbon 9, which provides more force to more reliably rotate the can 1 about the vertical axis, but also reduces the life of the batteries.

The battery compartment 7 on the can bottom 5 (located in the upper portion of FIG. 1) comprises first and second cylindrical cavities or recesses 16 and 17. Each cavity has a diameter and depth corresponding to the diameter and length, respectively, of an ordinary 1.5 volt, size D flashlight battery 18 or 19. The pair of cavities 16 and 17 provide for easy loading of the batteries 18 and 19 into the battery compartment 7, comparable to loading a double-barreled shotgun. Terminals 20 and wires 21 connect the battery compartment 7 to the motor 6. The terminals 20 comprise a spring wire inserted in slots in the bottom of the cavities 16 and 17.

The batteries 18 and 19 are held within the cavities 16 and 17 by a double-ended spring means 22. The double-ended spring means 22 may be formed by an electrically conductive wire 23 having its ends in-turned. The wire 23 is looped at its center point and mounted directly between the two cavities with a screw 24 or other pivot means so that the wire 23 may rotate between open and closed positions. In the open position, batteries 18 and 19 may be inserted into or removed from the cavities 16 and 17, and in the closed position the two in-turned ends of the wire 23 hold the batteries 18 and 19 within the cavities 16 and 17. The wire 23 is spring biased so as to provide a sufficient amount of force against the batteries 18 and 19 to ensure electrical contact with the terminals 20. The double-ended spring means 22 further acts as a switch to provide electrical contact between the two batteries 18 and 19 to power the motor 6.

Figures 2, 7:
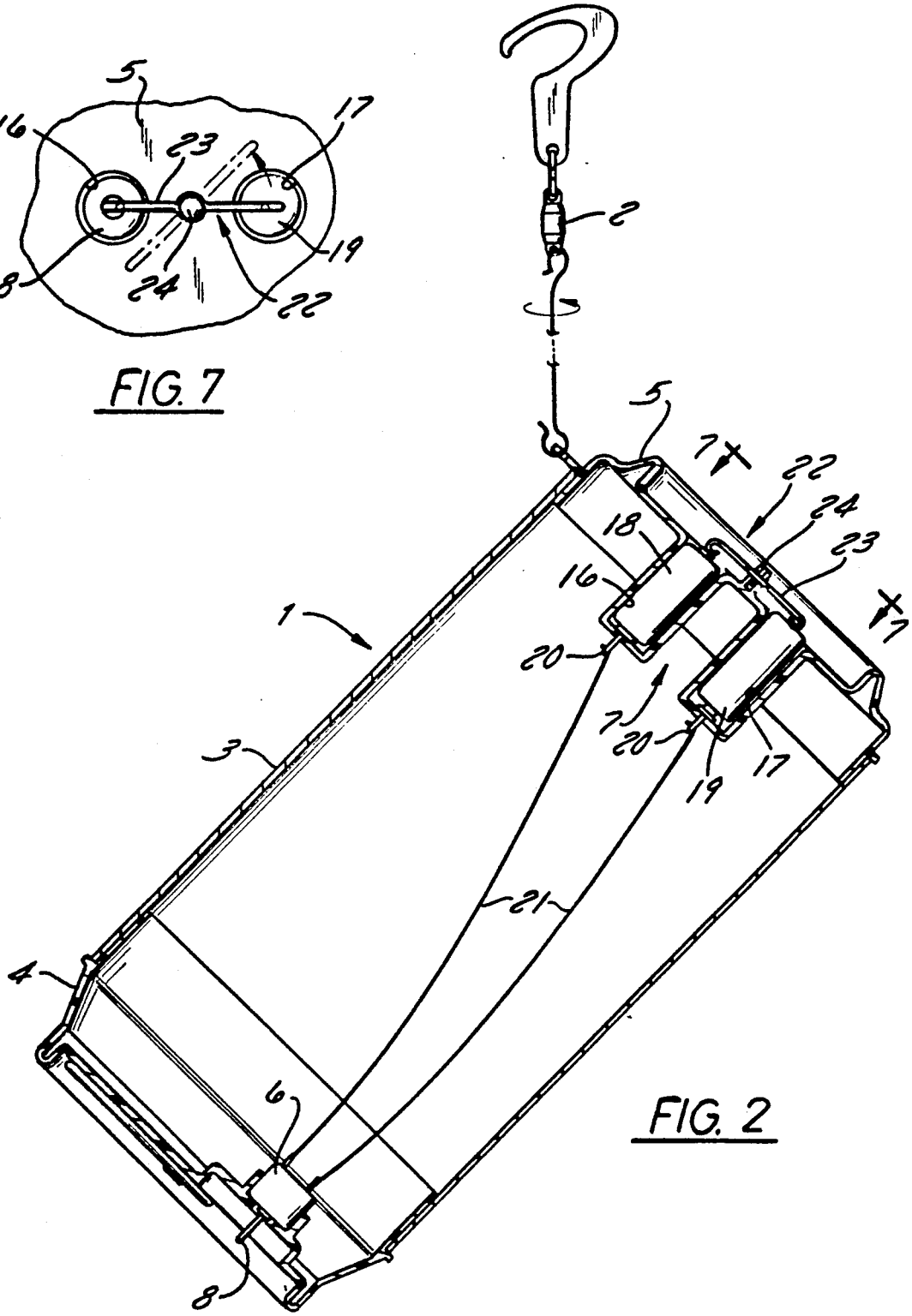
FIG. 2 is a cross-sectional view showing the internal components of the beverage advertising display shown in FIG. 1.
FIG. 7 is a fragmentary end view of the battery compartment and the double-ended spring taken along line 7—7 of FIG. 2.
Figure 5:
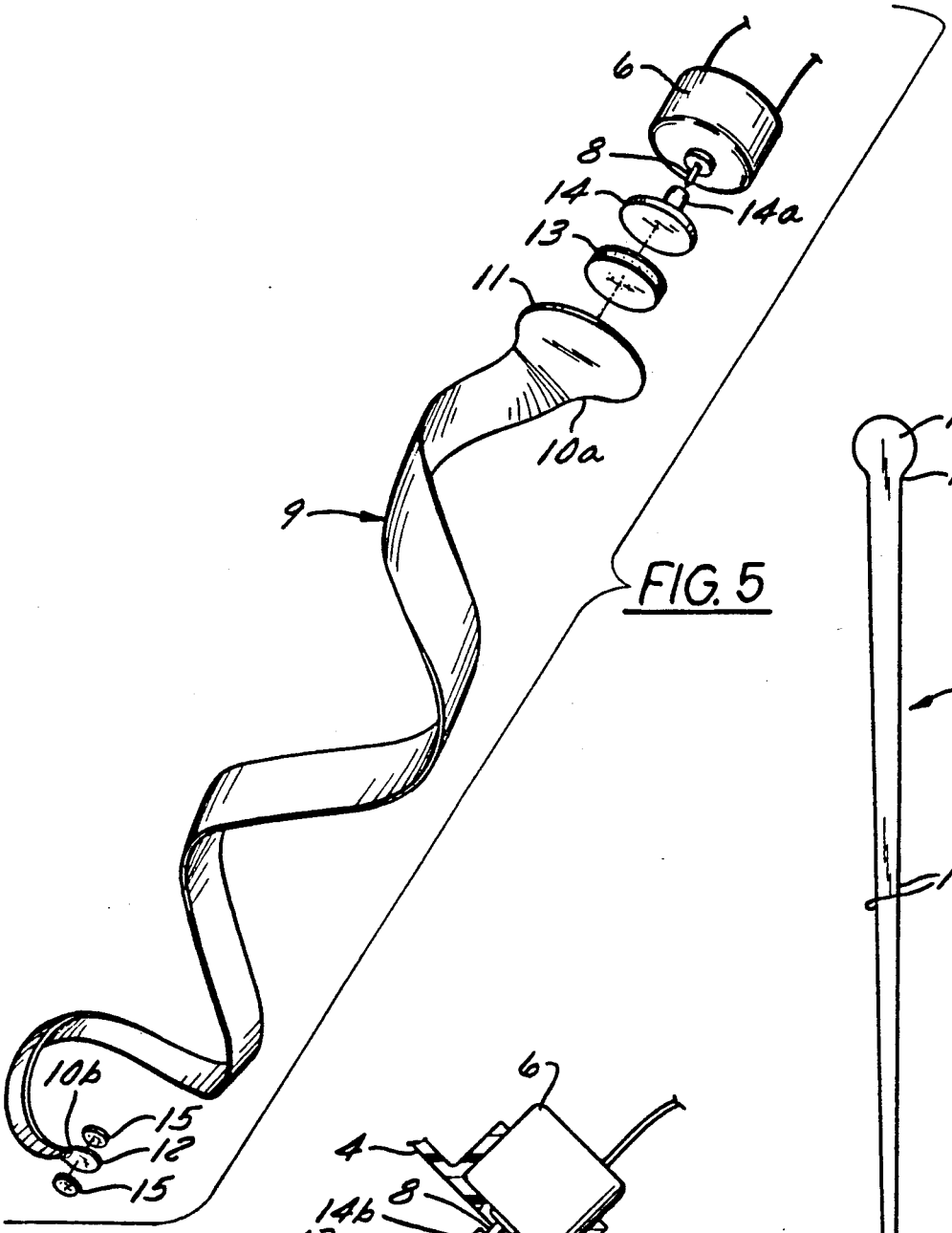
FIG. 5 is an exploded perspective view showing the connection of the ribbon to the motor and a weighted disc on the bottom end of the ribbon.
Figure 3:
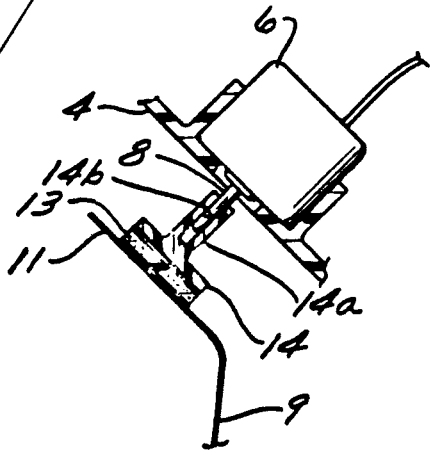
FIG. 3 is an enlarged sectional view of the motor and its disc mounted ribbon as shown in FIG. 2.
Figure 4:
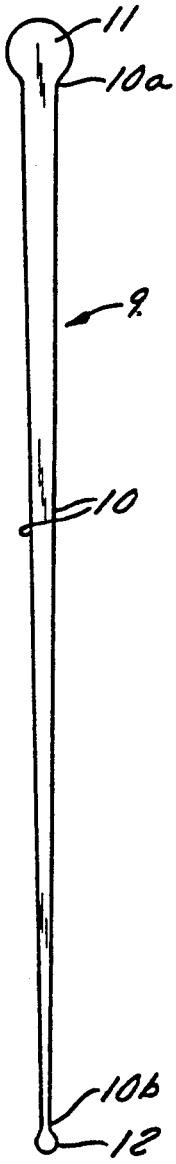
FIG. 4 is a reduced view of the ribbon lying in a straight, flat position.

The switch is turned "on" by rotating the double-ended spring means 22 so that its ends are in contact as shown by the solid lines of FIG. 7. The switch is turned "off" by rotating the spring means 22 away from the battery terminals to disconnect power to the motor as shown by the dotted line of FIG. 7. Since the battery compartment is on the can bottom (i.e. facing upwards), the batteries 18 and 19 will not fall out of the compartment when the switch is turned "off".

Upon insertion of the batteries 18 and 19 and activation of the motor 6, the ribbon 9 rotates in a manner which simulates a liquid pouring out of the beverage container 1. The configuration of the broad top circular surface area 11 of the ribbon 9 being concentrically mounted on a disc 14 for rotation by the shaft 8, together with the weighted bottom end 12, 15 of the ribbon 9, creates an auger-like effect to capture an air pocket in a fan-like motion which is more efficient than the prior known S-hook configuration. This improved efficiency of the rotating ribbon 9 gives the visual impression of a sparkling liquid flowing in a parabolic arc, with a relatively wide upper stream and narrow lower stream, which looks like a liquid flowing from a beverage can. This configuration further provides sufficient force to reliably rotate the display about the vertical axis. The disc-mounted, straight-edged ribbon provides the same visual effect regardless of which direction it is rotated, therefore the user may insert the batteries regardless of their polarity.

It is to be understood that the embodiment disclosed above is merely exemplary of the invention which may be embodied in various forms. Therefore, specific structural and functional details disclosed above are not to be interpreted as limiting, but merely as a basis for the claims and as a representative basis for teaching one skilled in the art to variously employ the present invention in any appropriately detailed structure. Changes may be made in the details of construction, arrangement and operation of the invention without departing from the spirit of the invention, especially as defined in the following claims.

I claim:

1. A beverage advertising display comprising:
an object depicting a beverage container;
rotatable support means for suspending the object from above and for rotating the object about a vertical axis;
a motor on the object, the motor including a rotatable shaft;
a battery compartment comprising a pair of cavities for holding a pair of batteries, the compartment being electrically connected to the motor;
a double-ended battery holding clip rotatably mounted between the cavities for holding the batteries within the cavities and for providing electrical contact between the batteries;
a disc mounted on the shaft; and
a flexible ribbon having one end thereof affixed to the disc, with the ribbon upon rotation of the shaft simulating a liquid pouring out from the object.

2. The beverage advertising display according to claim 1, wherein the disc includes an elongated hub at a center thereof, having a central bore therein, with the hub slipped snugly over the shaft.

3. A beverage advertising display comprising:
an object depicting a beverage container;
rotatable support means for suspending the object from above and for rotating the object about a vertical axis;
a motor on the object with the motor having a rotatable shaft;
a battery compartment for holding a battery, the compartment being electrically connected to the motor;
a disc mounted on the shaft;
a flexible ribbon having one end thereof affixed to the disc, with the ribbon upon rotation of the shaft simulating a liquid pouring out from the object;
the disc includes an elongated hub at the center thereof, having a central bore therein, with the hub slipped snugly over the shaft; and
a circular adhesive pad is affixed to the disc, and the ribbon is affixed to the pad.

4. The beverage advertising display according to claim 3, wherein the ribbon has straight edges tapered from a broad top width to a narrow bottom width, and the ribbon has a top circular surface area having a diameter in excess of the broad top width, with the top circular surface area being affixed to the pad.

5. The beverage advertising display according to claim 4, wherein the disc, pad and top circular surface area of the ribbon are affixed concentrically with the shaft.

6. The beverage advertising display according to claim 4, further comprising weighted discs concentrically affixed to both sides of a bottom end of the ribbon.

7. The advertising display according to claim 3, wherein the battery compartment comprises first and second cylindrical recesses, and a double-ended spring means mounted between the recesses, with the spring means being rotatable between, a closed position for holding a first and second battery within the first and second recesses, respectively, and for providing electrical contact between the batteries to power the motor, and an open position for removal and replacement of the batteries and for disconnecting power to the motor.

8. The beverage advertising display according to claim 3, wherein the object depicting the beverage container comprises a flexible rectangular sheet rolled edge to edge to form a cylinder with two open ends, a circular top section in a form of a can top inserted into one open end of the cylinder with the motor mounted on the can top, and a circular bottom section in the form of a can bottom inserted into the other open end of the cylinder with the battery compartment mounted on the can bottom.

9. The beverage advertising display according to claim 8, wherein the flexible rectangular sheet, has artwork depicting a particular beverage product printed thereon.

10. A battery powered advertising display which includes a battery compartment for holding a pair of batteries, comprising:
an object depicting a product to be displayed;
a pair of spaced apart cylindrical cavities in the object; and
a double-ended battery holding clip rotatably mounted between the cavities for holding batteries therein and for providing electrical contact between the batteries.

11. The battery powered advertising display according to claim 10, wherein the holding clip comprises a wire looped at its center point and its ends in-turned, and the wire is mounted on the object with a screw.

12. The battery powered advertising display according to claim 10, wherein the object depicts a beverage container;
means for swivel mounting the object from above for rotation about a vertical axis;
a motor with a rotatable shaft is mounted in a position corresponding to an opening of the object;
a disc is mounted on the shaft; and
a ribbon is affixed to the disc, with the ribbon simulating a flowing liquid upon rotation of the shaft.

13. The battery powered advertising display according to claim 12, wherein the disc includes an elongated hub at a center of the disc, with the hub having a central bore therein, and the hub is snugly slipped over the shaft.

14. The beverage advertising display according to claim 13, wherein a circular adhesive pad is affixed to the disc, and the ribbon is affixed to the pad.

15. The battery powered advertising display according to claim 14, wherein the ribbon has straight edges tapered from a broad top width to a narrow bottom width, and the ribbon has a circular top surface area with a diameter in excess of the broad top width concentrically affixed to the disc.

16. The beverage advertising display according to claim 15, wherein the disc, pad and top circular surface area of the ribbon are affixed concentrically with the shaft.

17. The battery powered advertising display according to claim 12, wherein the beverage container depicts an aluminum beverage can comprising:
a flexible rectangular sheet rolled edge to edge in a form of a cylinder with two open ends;
a circular top section depicting a can top attached to one end of the cylinder; and
a circular bottom section depicting a can bottom attached to the other end of the cylinder.

18. An advertising display device of a type including an object simulating a beverage container, overhead suspension means for supporting the object for rotation about a vertical axis, a motor on the object for rotating a shaft, a battery compartment electrically connected the motor, and an elongated flexible ribbon rotated by the shaft for simulating liquid pouring out from the object, wherein the improvement comprises:

a disc attached to the shaft, and one end of the ribbon being affixed to the disc;

the disc includes an elongated hub at the center thereof, having a central bore therein, and the hub is snugly slipped over the shaft; and a circular adhesive pad is affixed to the disc, and the ribbon is affixed to the pad.

19. The advertising display device of claim 18, wherein the ribbon has a width tapered from a broad top end to a narrow bottom end, with the top broad end including a substantially circular top surface having a diameter in excess of the tapered broad top end adjacent thereto, and with the circular top surface being concentrically affixed to the disc.

20. The advertising display device according to claim 19, wherein the disc, pad and top circular surface area of the ribbon are affixed concentrically with shaft.

21. The advertising display device of claim 19, further comprising weighted discs concentrically affixed to a bottom end of the ribbon.

22. The advertising display device of claim 21, wherein the battery compartment comprises a pair of spaced apart cylindrical cavities and double-ended spring means swivel mounted between the cavities for securing a pair of batteries therein and for providing electrical contact between the batteries to power the motor.

23. The advertising display of claim 18, wherein the object simulates a cylindrical aluminum beverage can comprising a rectangular flexible sheet rolled edge to edge to form a cylinder, a circular top section in a form of a can top inserted into one open end of the cylinder, with the motor mounted on the circular top section, and a circular bottom section in a form of a can bottom inserted into the other open end of the cylinder, with the battery compartment mounted on the circular bottom section.

* * * * *